United States Patent [19]

Kennedy et al.

[11] Patent Number: 4,680,020

[45] Date of Patent: Jul. 14, 1987

[54] TOY VEHICLE HAVING SIMULATED ENGINE NOISE

[76] Inventors: Melvin R. Kennedy, 2 Fifth Ave., New York, N.Y. 10011; Dietmar Nagel, 147 South Rd., Chester, N.J. 07930; Abraham A. Arad, 6 Minuteman Hill, Westport, Conn. 06880

[21] Appl. No.: 851,461

[22] Filed: Apr. 14, 1986

[51] Int. Cl.[4] ..... A63H 17/34

[52] U.S. Cl. ..... 446/414

[58] Field of Search ..... 446/409, 413, 414, 420, 446/270, 271, 410, 411, 412, 448, 449

[56] References Cited

U.S. PATENT DOCUMENTS

| | | | |
|---|---|---|---|
| 759,003 | 3/1904 | McCann | 446/420 |
| 2,137,357 | 11/1938 | Schmid | 446/409 |
| 2,234,837 | 3/1941 | Allen | 446/414 |
| 3,165,860 | 1/1965 | Glass et al. | 446/414 |
| 3,232,003 | 2/1966 | Doe | 446/271 |
| 3,411,236 | 11/1968 | Fileger et al. | 446/420 |
| 4,245,427 | 1/1981 | Accornero | 446/409 |
| 4,280,300 | 7/1981 | Kulesza et al. | 446/414 |

FOREIGN PATENT DOCUMENTS

| | | | |
|---|---|---|---|
| 1283722 | 11/1968 | Fed. Rep. of Germany | 446/409 |
| 1087177 | 2/1955 | France | 446/414 |
| 1196142 | 6/1970 | United Kingdom | 446/414 |

*Primary Examiner*—Robert E. Bagwill
*Assistant Examiner*—Terrence L. B. Brown
*Attorney, Agent, or Firm*—Michael Ebert

[57] ABSTRACT

A free-wheeling toy vehicle which when propelled makes a repetitive sound simulating the noise of an internal combustion engine. The vehicle includes a chassis having bearings supporting front and rear wheel axles. Lying on top of the chassis between the axles is a drum having an elastic drum head. Cantilevered from one end of the chassis is a clapper formed of a flat metal spring terminating in a striker, the spring being biased so that the striker normally rests on the drum head. A finger projects downwardly from the clapper, the tip of the finger being successively engaged by the equispaced teeth of a hub mounted on one of the wheel axles and turning therewith. Each time the finger tip is engaged by a moving tooth, the finger is pushed forward to raise the striker above the drum head; and when the finger than falls between adjacent teeth, the striker is released to hit the drum head to generate a thumping sound. The repetition rate of the clapper action depends on the running speed of the vehicle and therefore acts to create a realistic motor noise.

6 Claims, 5 Drawing Figures

TOY VEHICLE HAVING SIMULATED ENGINE NOISE

BACKGROUND OF INVENTION

1. Field of Invention:

This invention relates generally to toy vehicles, and in particular to a toy vehicle which is a small scale replica of an actual vehicle and which when propelled makes a noise that depends on the speed of the vehicle to simulate an actual engine noise.

2. Status of Art:

In most forms of play, the child seeks to emulate an adult activity; for in doing so, the child prepares to enter the adult world. In playing with a doll, the child will often assume the role of a mother; and in playing with toy vehicles, the child pretends to be driving a real-life automobile or truck. Hence, in the field of toy vehicles, children have a strong preference for those toys which have the familiar appearance of an existing model car. Most children are quick to recognize the difference between, say, a Cadillac and a Mercedes.

One highly popular form of toy vehicle is a motorless, free-wheeling miniature car which includes a cast metal replica of the body of a particular model of an actual vehicle. Children collect such miniatures and take pride in the range of their collection which includes many well-known models. To play with these toys, the child has only to push them along a table or ground surface. In the case of a miniature car made of cast metal having a relatively heavy mass, the car, if it has good bearings for the wheel axles, is capable of running a fairly long distance in response to a strong forward push.

There is, however, one respect in which a miniature toy car fails to replicate an actual running vehicle, and that is engine noise. In a vehicle having a multi-cylinder internal combustion engine, a thumping sound is heard each time the combustion mixture is fired in a cylinder. Since the cylinders are fired successively at a rate which depends on car speed, what is heard is a continuous series of thumping sounds whose repetition rate increases with speed.

But in a typical miniature toy car, when the car runs, it does so silently, and the absence of engine noise impairs the play value of the car. Noise is associated in a child's mind with work and effort. Thus, when a nail is hammered into wood, one hears a loud bang each time the hammer strikes the head of the nail, and the faster the hammering rate, the greater is the repetition rate of these sounds. It is for this reason that a child who pushes a car forward with all his strength is not rewarded psychologically when there is no sound which reflects his effort.

SUMMARY OF INVENTION

In view of the foregoing, the main object of this invention is to provide a small scale, free-wheeling toy vehicle which is capable of running when propelled by hand and which then generates a sound simulating the engine noise of an actual vehicle.

More particularly, an object of this invention is to provide an engine noise generator in a toy vehicle which produces in the course of its run a continuous series of thumping sounds that simulate the motor noise of a multi-cylinder internal combustion engine.

A significant feature of the invention is that the noise generator which is operatively coupled to one of the wheel axles of the toy vehicle imposes only a very light load thereon, so that the noise generator does not slow down or interfere with the running of the vehicle.

Briefly stated, these objects are attained in a free-wheeling toy vehicle which when propelled makes a repetitive sound simulating the noise of an internal combustion engine. The vehicle includes a chassis having bearings supporting front and rear wheel axles. Lying on top of the chassis between the axles is a drum having an elastic drum head. Cantilevered from one end of the chassis is a clapper formed of a flat metal spring terminating in a striker, the spring being biased so that the striker normally rests on the drum head. A finger projects downwardly from the clapper, the tip of the finger being successively engaged by the equispaced teeth of a hub mounted on one of the wheel axles and turning therewith. Each time the finger tip is engaged by a moving tooth, the finger is pushed forward to raise the striker above the drum head; and when the finger than falls between adjacent teeth, the striker is released to hit the drum head to generate a thumping sound. The repetition rate of the clapper depends on the running speed of the vehicle and therefore acts to create a realistic motor noise.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
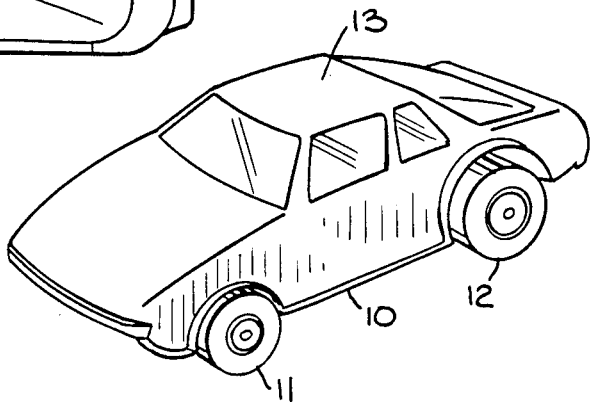
FIG. 1 is a perspective view of a toy vehicle in accordance with the invention.

Referring now to FIG. 1 of the drawing, a small scale toy vehicle in accordance with the invention is provided with a molded plastic chassis 10 supporting a pair of front wheels 11 and a pair of rear wheels 12. Mounted on chassis 10 is a hollow body 13, preferably made of cast metal to create a form that reproduces in miniature a full-scale model of an actual vehicle.

Figure 2:
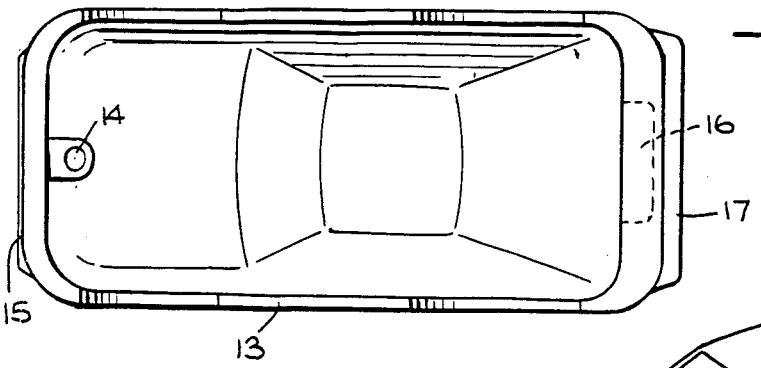
FIG. 2 illustrates the underside of the body of the vehicle.
Figure 3:
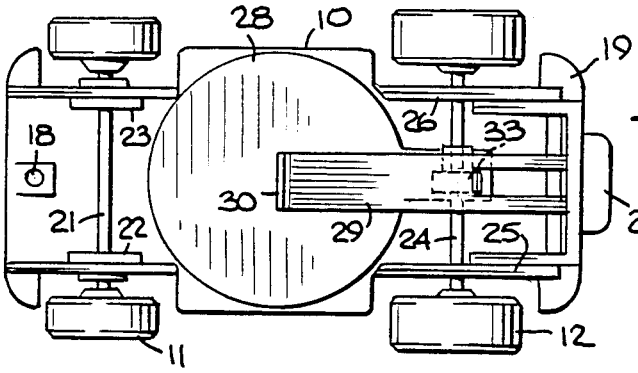
FIG. 3 is a top view of the vehicle chassis.
Figure 4:
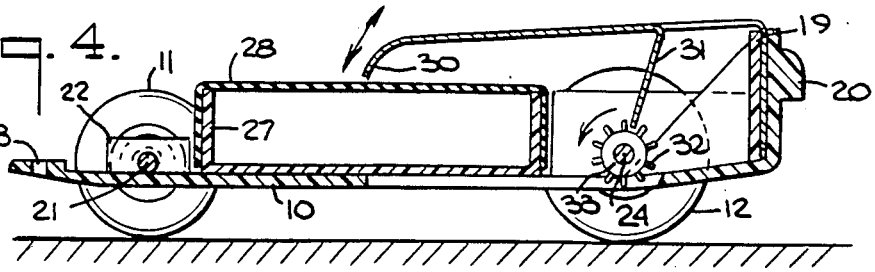
FIG. 4 is a longitudinal section taken through the chassis.
Figure 5:
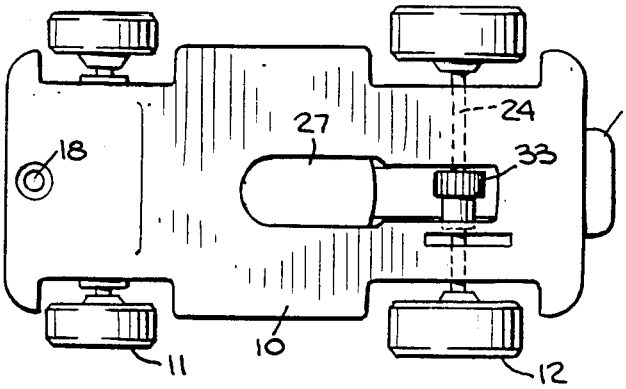
FIG. 5 is a bottom view of the vehicle chassis.

As shown in FIG. 2, the interior of body 13 has a screw-receiving socket 14 adjacent the center of its front edge 15. A rectangular slot 16 is formed in the stern 17 of the body. Chassis 10, as shown in FIG. 3, includes a screw-receiving bore 18 and a rear ledge 19 having a lug 20 projecting therefrom. Hence, in assembling the vehicle, lug 20 of the chassis is inserted in slot 16 of the body, and the body is then placed over the chassis to bring hole 18 of the chassis in registration with socket 14 in the body. All that is then necessary to secure the body to the chassis is a single screw which is inserted in hole 18 and turned into socket 14.

Front wheels 11, as shown in FIG. 3, are mounted at the ends of a front wheel axle 21 which passes through bores in a pair of parallel blocks 22 and 23 anchored in the chassis adjacent the front thereof. The blocks are formed of low friction material such as TEFLON TM (E.I. Du Pont de Nemours Corp.) (polytetrafluoroethylene) (PTFE), so that the blocks function as low friction bearings. Rear wheels 12 are mounted at the ends of a rear wheel axle 24 which is supported by a pair of bearing blocks 25 and 26 adjacent the rear of the chassis.

Mounted on the chassis and enclosed by the body between the front and rear wheel axles 21 and 24 is a circular drum 27 formed of rigid plastic material. Drum 27 is covered by a drum head 28 formed of an elastomeric material such as rubber or latex. Drum 27 is actuated by means of a clapper 29 formed of flat spring metal such as bronze. The clapper is cantilevered from the rear ledge 19 of the chassis, the leading end of the clapper being bent down to form a striker 30. The spring is biased so that striker 30 normally rests on drum head 28.

Struck out of metal clapper 29 by die cutting is a downardly-bent finger 31 whose tip cooperates with the equispaced teeth 32 of a plastic hub 33 mounted on rear axle 24 and rotating therewith. Thus, as hub 33 rotates, the teeth thereof successively engage the tip of finger 31. Each time the finger is engaged by a moving tooth, it is pushed forward, this action causing the finger to raise striker 30 above drum head 28. And as the hub continues to turn, the finger tip then falls into the space between adjacent teeth, thereby releasing the clapper and causing the striker to hit the drum head.

The resonance characteristics of the drum are determined by its interior volume and the characteristics of the drum head. Had use been made of a conventional drum head, the resultant sound would have been fairly high pitched. However, because the drum head is elastic, the resultant thumping sound is somewhat dull and low-pitched and therefore resembles the thumping sound of an internal combustion engine each time the fuel/air mixture is ignited in a combustion chamber.

In practice, the hub has at least six teeth; hence, six thumping sounds are produced during each revolution of the rear axle. The repetition rate of the thumping sounds is therefore low when the car runs at low speed and increases as the car speed increases. In this way, as the car gains in speed, the resultant sound reflects the car speed to provide an engine-like sound that simulates the motor noise of an actual car.

The drag of the drum clapper on the vehicle is slight, for it takes very little energy to cause the finger to raise the clapper. Hence, the running of the car is not significantly affected by the drum mechanism coupled thereto.

While there has been shown and described a preferred embodiment of a toy vehicle having simulated engine noise in accordance with the invention, it will be appreciated that many changes and modifications may be made therein without, however, departing from the essential spirit thereof.

We claim:

1. A motorless, free-wheeling toy vehicle which when propelled by a player to run at a changing speed makes a repetitive sound simulating the noise of an internal combustion engine as a function of running speed, said vehicle comprising:

A. a chassis having bearings supporting front and rear wheel axles;

B. a miniature sound producing drum having a resonance chamber and a drum head formed of elastic material enclosing the resonance chamber, said drum being mounted on top of the chassis between the wheel axles;

C. a clapper cantilevered from one end of the chassis, said clapper being formed of a flat metal spring terminating in a striker that normally rests on the drum head, said spring having a finger located between the striker and the cantilevered end of the clapper and projecting downwardly therefrom at a position displaced from the drum; and D. a hub mounted on one of said axles, located outside of said resonance chamber, said hub having spaced teeth which when the axle rotates at a rate depending on the running speed then successively engage the tip of the finger, whereby each time the finger is engaged by a moving tooth of the spaced teeth, the finger is pushed forward to raise the striker above the drum head, and when the finger then falls between adjacent teeth, the striker is released to hit the elastic drum head to generate a low-pitched thumping sound, the repetition rate of the clapper action depending on the running speed of the toy vehicle as determined by the player.

2. A toy vehicle as set forth in claim 1, wherein said finger is defined by a die cut in the flat metal spring.

3. A toy vehicle as set forth in claim 1, further including a hollow body mounted on the chassis which is formed to simulate the appearance of a given model of an actual vehicle.

4. A toy vehicle as set forth in claim 3, wherein said body is of cast metal.

5. A toy vehicle as set forth in claim 1, wherein axles are supported in bearing blocks mounted on said chassis and formed of low-friction plastic material.

6. A toy vehicle as set forth in claim 3, wherein said chassis is provided at its rear with a ledge from which said clapper is cantilevered, said ledge having a projecting lug which is received in a slot formed in the rear of the body, said body having an interior screw-receiving socket which registers with a hole in the front of the chassis whereby said body is secured to said chassis by a single screw.

* * * * *